US006209439B1

(12) United States Patent
Repac et al.

(10) Patent No.: US 6,209,439 B1
(45) Date of Patent: Apr. 3, 2001

(54) GARLIC CUTTER

(75) Inventors: Cedomir Repac, Brechen (DE); Branko Culig, Gradac (SI)

(73) Assignee: Petra Repac, Brechen (DE)

( * ) Notice: Subject to any disclaimer, the term of this patent is extended or adjusted under 35 U.S.C. 154(b) by 0 days.

(21) Appl. No.: 09/151,112

(22) Filed: Sep. 10, 1998

(30) Foreign Application Priority Data

Jun. 25, 1998 (DE) ..... 298 11 295

(51) Int. Cl.[7] ..... B26D 1/02
(52) U.S. Cl. ..... 83/858; 83/932; 241/169.2
(58) Field of Search ..... 83/858, 932; 30/114; 241/168, 169, 169.2

(56) References Cited

U.S. PATENT DOCUMENTS

| | | | | |
|---|---|---|---|---|
| 1,746,979 | * | 2/1930 | Woolley | 83/858 |
| 2,245,978 | * | 6/1941 | Hyland | 83/858 |
| 2,611,404 | * | 9/1952 | Weeks | 83/858 |
| 2,621,691 | * | 12/1952 | Brualdi | 83/858 |
| 3,216,474 | * | 11/1965 | Popiel | 83/858 |
| 4,137,807 | * | 2/1979 | Schaumberg | 83/858 |
| 4,346,634 | * | 8/1982 | Jones | 83/858 |
| 4,573,384 | * | 3/1986 | Jones | 83/858 |
| 4,955,271 | * | 9/1990 | Boutin-lester | 83/858 |
| 5,207,137 | * | 5/1993 | Baril | 83/858 |
| 5,245,902 | * | 9/1993 | Pereira | 83/932 |
| 5,271,317 | * | 12/1993 | Aguerrevere et al. | 83/858 |
| 5,662,033 | * | 9/1997 | Yawman | 83/932 |
| 5,832,804 | * | 11/1998 | Dudley et al. | 83/932 |

FOREIGN PATENT DOCUMENTS

| | | |
|---|---|---|
| 832051 | 2/1952 | (DE) . |
| 1750135 | 8/1957 | (DE) . |
| 2112992 | 4/1971 | (DE) . |
| 297 13 837 U1 | 11/1997 | (DE) . |

* cited by examiner

*Primary Examiner*—M. Rachuba
(74) *Attorney, Agent, or Firm*—Liniak, Berenato, Longacre & White

(57) ABSTRACT

A garlic cutter having a housing and a beaker shaped structure adapted to receive garlic rotatably disposed in the housing. The beaker shaped structure has a cutting grid for cutting garlic or other vegetables. An upper part, bearing a punch, threadingly engages the housing such that when rotated the punch is urged towards the cutting grid pushing the garlic through the cutting grid. Preferably, the punch and cutting grid are rotated in unison upon rotation of the upper part to allow a plurality of pegs of the punch to align with and enter corresponding apertures in the cutting grid. A cutting blade is non-rotatably disposed beneath the beaker shaped structure to cut garlic emerging from the cutting grid.

7 Claims, 4 Drawing Sheets

GARLIC CUTTER

BACKGROUND OF THE INVENTION

1. Field of the Invention

Figure 1:
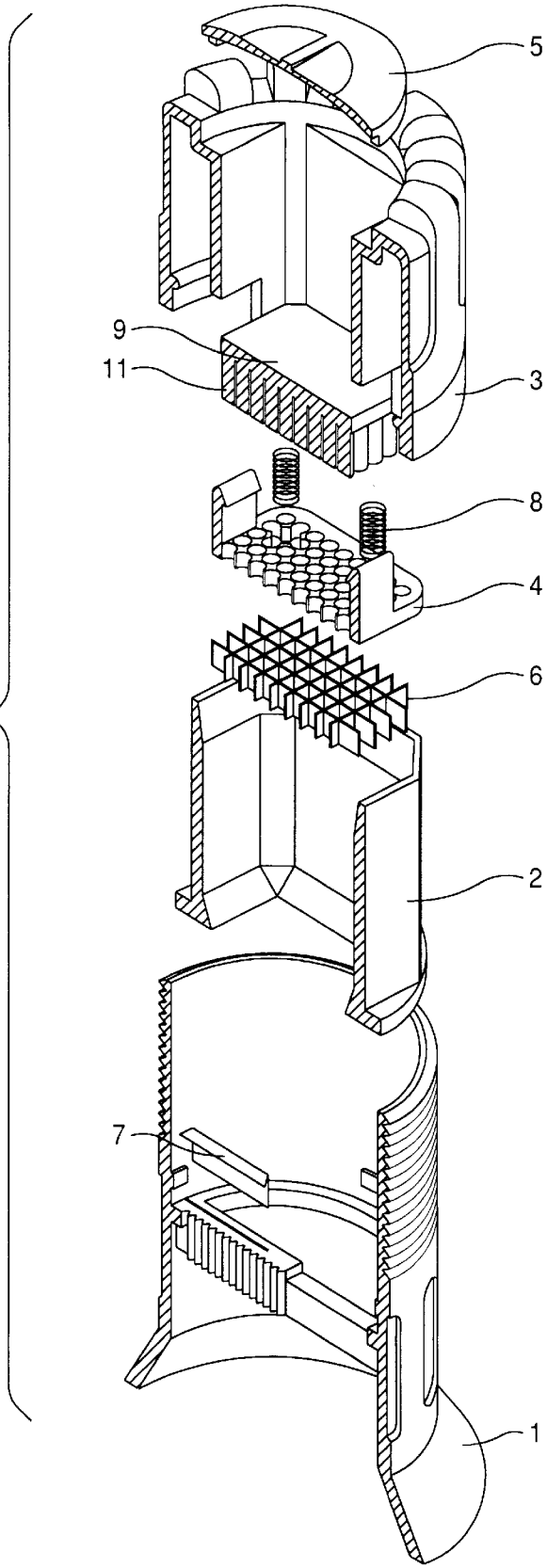

The invention concerns a garlic cutter which may also be used for other vegetables, for instance onions.

2. Description of the Prior Art

Known implements for mincing garlic are designed as a sort of press, the garlic being forced by a punch through a grid. Essentially the vegetable is being squeezed, namely being processed by the apertures, into small strands or streamers. The garlic is less cut than pressed in this procedure. Moreover, comparatively large parts remain caught in the implement and do not pass through the apertures.

The German Offenlegungsschrift 21 19 992 describes an onion cutter wherein an axially adjustable punch forces the onion through star-arrayed cutting blades, so that the onion is cut into a plurality of sectors of a circle. These sectors are cut into individual pieces by a knife inserted transversely.

A similar onion cutter designed with cutting wires rotating relative to the onion is disclosed in the German Gebrauchsmuster 1,750,135.

The German patent 832,051 discloses an implement for mincing onions, fruit or other goods and comprises a housing bearing a cutting blade at its lower side and an upper part fitted with a punch affixed thereto. The punch, during operation and rotation relative to the housing, carries out an axial motion toward the co-rotating cutting grid. By means of this axially displaceable punch, the fruit is moved or pressed through a co-rotating cutting grid at the output side of which are formed corresponding streamers or strands of square cross-section. These segments then are longitudinally minced by the blade mounted behind the cutting grid and consequently onion cubes are made. The fruit is neither pressed nor rubbed Rather, the onion on one hand is cut by the grid and on the other hand is cut transversely by the blade. This results in finely cut onion cubes as end products. The cutting grid cuts the fruit in two dimensions, and therefore pins or bars are generated which subsequently are minced by the blade into cubes. The punch is designed in such manner that its front side shape matches the shape of the two-dimensional cutting grid, that is the front-side shape consists of a number of pegs pushing the onion segments through the cutting grid. The blade is mounted in stationary manner on the housing, whereas the punch and the cutting grid is mounted rotatably and preferably so that one actuating element can set both in rotation and that, by means of the spindle, they generate an axial punch motion relative to the co-rotating cutting grid.

Such design of the state of the art incurs the drawback that the punch containing a plurality of pegs can be cleaned only laboriously. Many guide means and components of complex shape are present that make thorough cleaning cumbersome and time-consuming because the garlic makes contact with many components of different configurations.

The objective of the invention is to create a garlic cutter or cutters for vegetables that can easily be dismantled into components of simple shapes allowing rapid cleaning.

The present invention alleviates the drawbacks associated with the prior art.

SUMMARY OF THE INVENTION

The garlic cutter of the invention contains a beaker-shaped inner structure receiving the garlic. The structure is rotatably supported in the housing and receives the cutting grid. Accordingly, the garlic cutter of the invention is composed of three components, the housing, the upper part and the beaker-shaped inner part or inner structure. The inner structure is placed in the base body, and the garlic inside the inner structure. Next the upper part is rotated, whereby its inside thread engages the mating thread of the housing and effects the axial displacement and the cutting of the garlic clove. Then the inner structure rotates together with the upper part which bears the punch. Because the inner structure is beaker-shaped, the garlic is prevented from moving away laterally during the pressing or cutting procedure, further from soiling other elements, for instance guide elements or further components. The inner structure being the sole component, aside the cutting blade and the punch, that comes into contact with the garlic. Cleaning, following disassembly, is essentially limited to inner structure. On account of its smooth surfaces, even this inner structure is easily cleaned.

The blade is affixed at the underside of the housing to a bridge resting on mutually opposite housing locations. Advantageously, the blade does not run beyond the center of the cutting grid. Otherwise, the center always would be covered by the blade and pieces of garlic might accumulate at the blade or its tip and entail malfunction.

In a preferred embodiment, the inner structure rotating in the housing is rotatably held in the proper operational position by a detent mechanism, with its cutting grid held exactly above the blade, and can easily be removed for cleaning. The inner structure is engages the housing by means of detent elements such as toes and can be released for cleaning by merely pressing the cutting grid or its frame from below to overcome the toes' resistance. Thus the user can easily remove the inner structure and clean the cutting grid affixed.

In another embodiment, the cutting grid is easily removable from the inner structure. The two parts are connected by the engagement of the particular ends of metal elements forming the cutting grid with geometrically locking clearances in the lower rim zone of the inner structure. Snap connection between the cutting grid (and any frame) with the rim of the inner structure also is feasible.

In a further embodiment of the invention, the blade or the blade holder together with the blade are made detachable from the housing to facilitate cleaning the parts. In the simplest case the connection of the two parts is implemented by merely placing the blade in a housing-stationary clearance. Again affixation can be implemented between the blade holder and the housing by a bayonet lock mounted in such manner that in operation the reactive pressure on the blade biases the blade holder toward the closed position. The garlic cutter when designed for right-handed users is fitted with a right-hand thread and therefore the upper part is rotated to the right relative to the lower part for the purpose of pressing the vegetable against the cutting grid, and preferably the bayonet lock holding the blade holder against the housing holder is configured in such manner that it shall be opened by leftward rotation and closed by rightward rotation. In this manner accidental opening is precluded during the cutting procedure.

In this design of a garlic cutter, the inner structure when in operation rotates relative to the housing holding it. The drive rotating the inner structure together with the punch can be implemented either using a punch with a non-circular and preferably a substantially square cross-section, and hence dipping into a correspondingly shaped substantially square cavity of the inner structure, or guide channels for the punch mounted in the inner structure, the punch in turn being fitted with guide toes entering these channels. In a symmetrical design of punch and inner structure, assembly can be carried out at different positions. However, there is only one possible position in an asymmetrical configuration. Preferably, the punch cross-section shall be square with beveled edges, resulting in four different but wholly equivalent assembly modes for punch and inner structure. The bevels of the edges preclude "dead" right angles, i.e. corners difficult to clean.

In a further innovation of the invention, especially appropriate for the above discussed garlic cutter, the punch pushes the garlic clove through the cutting grid against the cutting blade. This punch comprises a plurality of pegs able to enter the apertures of the cutting grid and which preferably are planar at the front, further a front plate resiliently seated on the punch and covering the pegs, whereby the plate together with the front faces of the pegs forms a closed punch surface. Preferably, the front plate comprises as many boreholes as there are pegs in the punch. A single peg passes through each aperture. In the initial position, and until the end of punch advance to the cutting grid, a substantially planar surface will be formed. When, during advance and cutting the garlic clove, the punch plate has reached the cutting grid, then upon further advance, the pegs will be pushed through the boreholes in the plate and through the cutting grid in order to fully press the garlic through the cutting grid. In one embodiment mode, compression springs are mounted between the perforated plate and the pegs and will, upon pressure relief, return the plate into its initial position, whereby the substantially closed punch surface is formed again. This closed punch surface on one hand assures completely mincing the garlic by substantially averting that any garlic residues remain in any cavity, and on the other hand that during cleaning, the smooth lower punch surface can be cleaned especially quickly.

Further objectives, advantages, features and applicabilities of the present invention are elucidated in the following description of an illustrative embodiment of the invention in relation to the drawing. All described and/or graphically shown features whether per se or in arbitrary combination are an object the present invention, regardless of their summarization in the claims or their mutual relationships.

Figure 2:
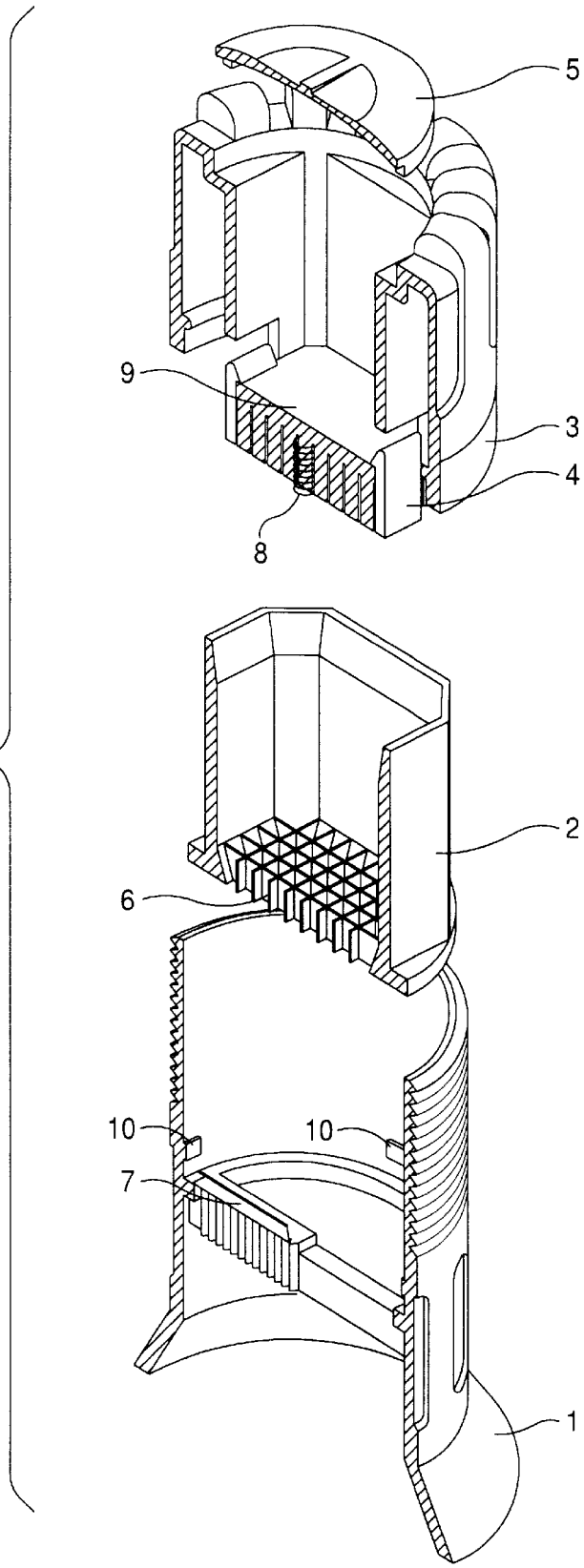
Figure 3:
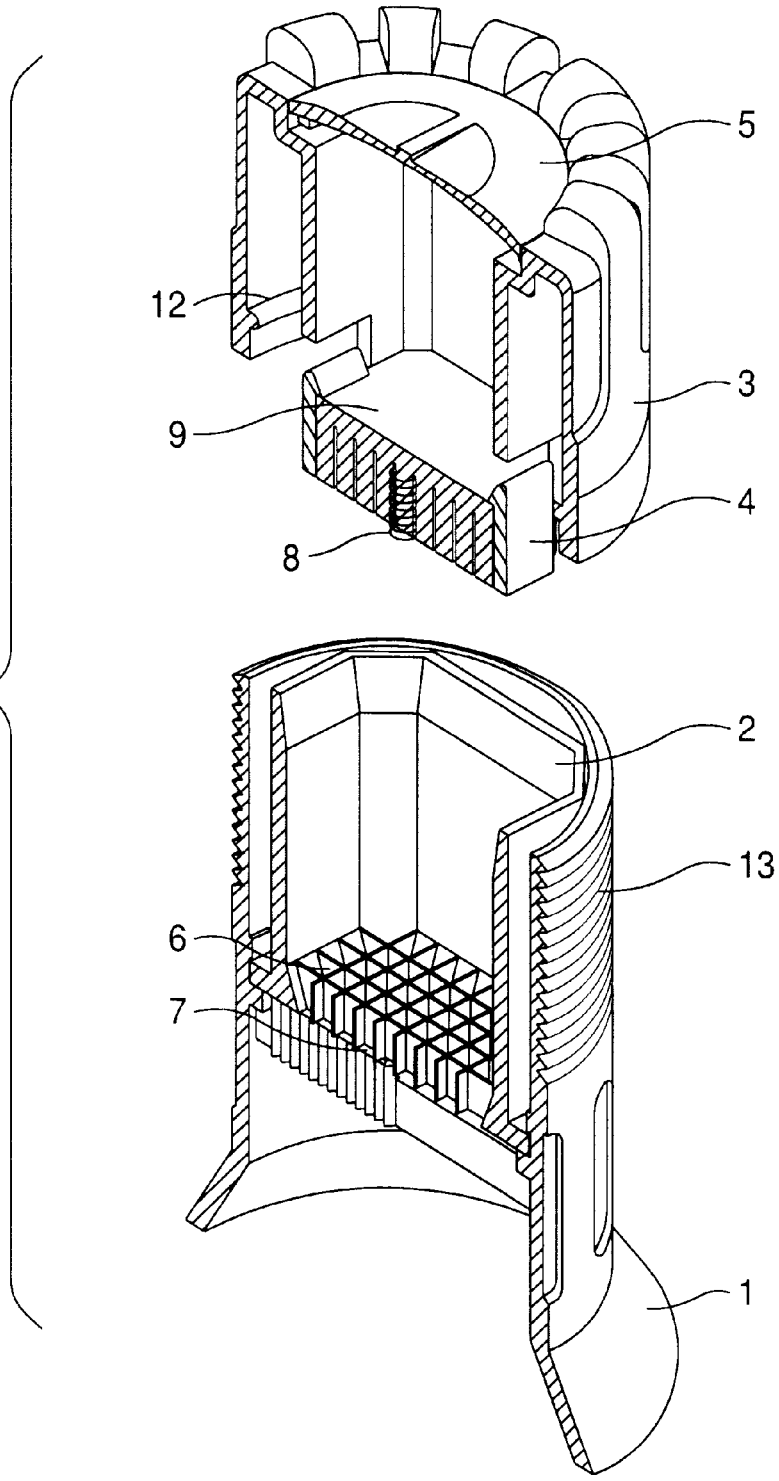
Figure 4:
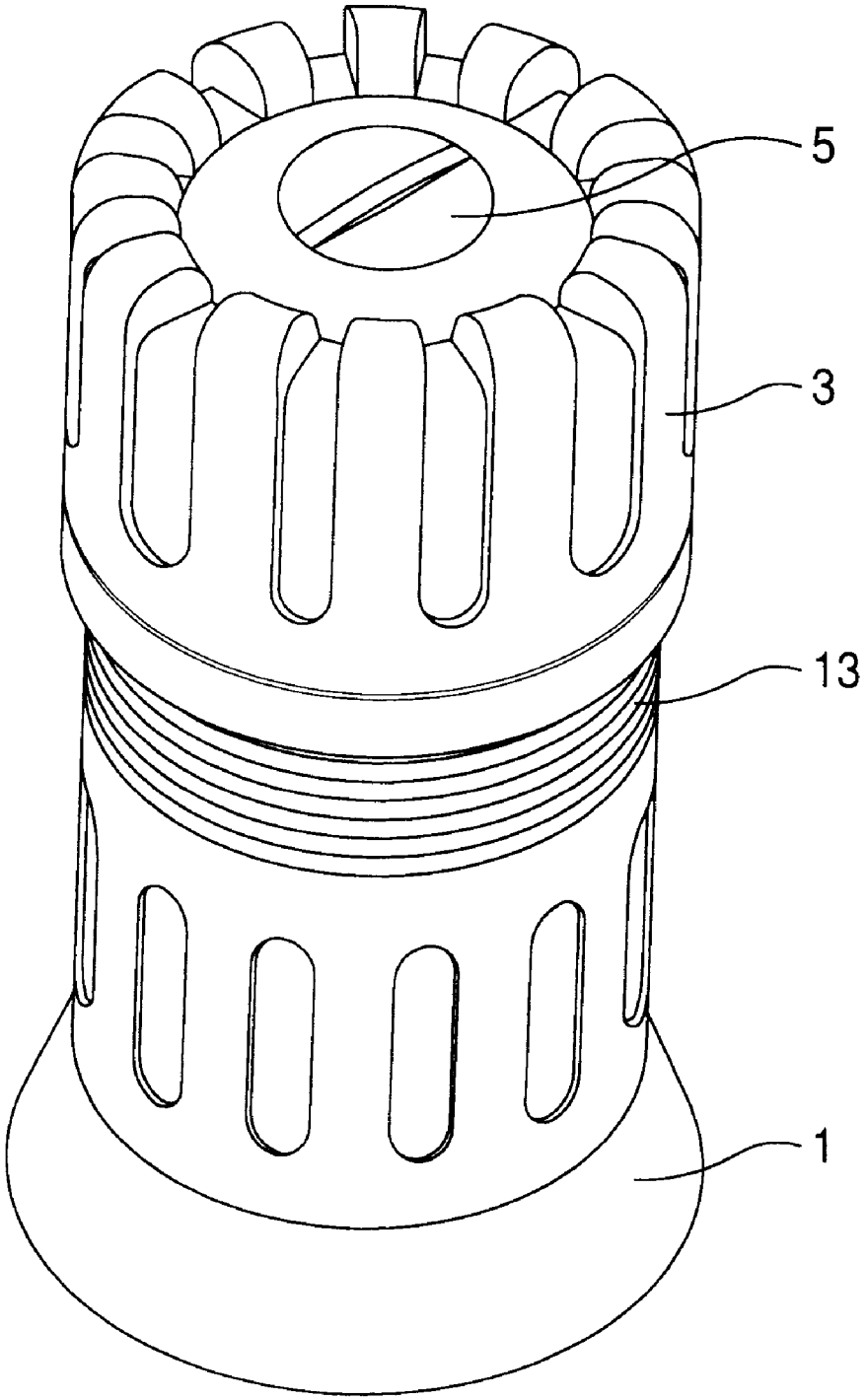

FIG. 1 is an exploded perspective view of the individual components of a garlic cutter of the invention, FIG. 2 shows the garlic cutter disassembled for cleaning, FIG. 3 shows of FIG. 2 in the ready-to-fill state, FIG. 4 shows the assembled garlic cutter.

FIG. 1 is a sectional and exploded view of the individual components of an embodiment of the present invention of a garlic cutter. The main components are the housing 1 receiving the beaker-shaped inner structure 2 and the upper part 3. The plate 4 and the lid 5 are affixed to the upper part 3. The cutting grid 6 is inserted in the inner structure 2 and the cutting blade 7 is inserted into the housing 1. The springs 8 can be set on several of the pegs 11 of the punch 9. The plate 4 comprises two upward-pointing arms with inward-directed hooks that, in the assembled state, will enclose the punch 9. In that case the springs 8 press the plate 4 away from the punch, while the hooks of the plate 4 hold this plate to the punch 9.

FIG. 2 shows the individual components of FIG. 1 in the ready-to-use state, for instance the way the garlic cutter is apart for cleaning purposes, namely the three main components of housing 1 with inserted blade 7, inner structure 2 with inserted cutting grid 6 and upper part 3 with lid 5, punch 9, springs 8 and plate 4. The toes 10 are also shown and are mounted above a metal ring (not shown) separately and acting as a slider for the inner structure 2. If the inner structure 2 is displaced from the position shown in FIG. 2 over the toes 10 into the housing 1, then the inner structure 2 will rest on the ring in the housing 1. The toes 10 prevent the inner structure 2 from slipping out and upward. The inner structure 2 then is supported rotatably inside the housing 1 while secured there within.

FIG. 3 shows the garlic cutter of the invention in the open state, that is ready to be filled. As just described above, the inner structure 2 has now been inserted into the housing 1. The cutting grid 6 is located exactly above the blade 7. The garlic or the other vegetables to be minced then are placed into the beaker-shaped inside space of the inner structure 2 and thereby rest on the cutting grid 6.

To mince the garlic, the upper part 3 together with its punch 9 is placed inside the inner structure 2. Rotation of the upper part 3 also drives the inner structure 2 together with garlic and cutting grid 6 into rotation. On the other hand the blade holder with the blade 7 is stationary relative to the housing 1.

If now the upper part 3 is displaced downward and rotated further, the inside thread 12 (of which only one turn is shown here) present at the lower outer rim of the upper part 3 will engage the outside thread 13 of the housing 1. As a result the upper part 3 slowly threads its way downward and presses the garlic (located underneath the punch 9 and above the cutting grid 6) through this cutting grid. Thereby strands of garlic are produced by the cutting grid 6 and upon rotating this cutting grid above the blade 7 are cut into small parallelipipeds.

As shown in particular by FIG. 1, the punch 9 comprises a plurality of pegs 11 associated with a plate 4 containing as many apertures as there are pegs 11. As shown in FIG. 2, the plate 4 can be affixed by two clamps to the punch 9. FIG. 1 shows two (of five) springs 8 forcing the plate 4 away from the punch 9. The plate 4 is stopped by the cutting grid 6 only when impacting it at the end of pressing and then is shifted against the punch 9. The springs 8 are compressed and the pegs 11 start projecting beyond the plate 4. The pegs 11 pass through the apertures of the cutting grid 6 and in this manner push the last garlic remnants through the grid against the blade 7 rotating below. In this compressed end state, the top-side hooks of the clamps are detached from the punch 9. If the user opens the garlic cutter or if he unscrews the upper part 3 together with punch 9 in the upward direction, the springs 8 will again press the plate 4 downward and a practically planar surface consisting of the plate 4 and the front sides of the pegs 11 is produced, which is easily cleaned.

FIG. 4 shows the assembled garlic cutter of the invention. Therein the upper part 3 is shown with its lid 5 screwed on the outside thread 13 of the housing 1. For greater stability, the housing 1 is fitted with a widened footing.

REFERENCES

1 housing
2 inner structure
3 upper part
4 plate
5 lid
6 cutting grid
7 cutting blade
8 springs
9 punch
10 toes

11 pegs
12 inside thread
13 outside thread.

What is claimed is:

1. A garlic cutter comprising:

a housing (1) bearing a cutting blade (7);

an upper part (3) bearing an affixed punch (9) which in an operational state during rotation relative to the housing (1) moves axially toward a co-rotating cutting grid (6); and a beaker-shaped inner structure (2) adapted to receive garlic and rotatably supported in the housing and containing the cutting grid (6), wherein the inner structure (2) is held by a detent mechanism in the housing (1) and is easily removable for cleaning, the cutting grid (6) is detachable from the inner structure (2) for purposes of cleaning, the cutting blade (7) is detachable from the housing for purposes of cleaning, a cross-section of the inner structure (2) is substantially square and corresponds top that of the punch (9), said punch further comprises;

a plurality of pegs (11) which are insertable in the corresponding apertures of the cutting grid (6); and a plate (4) resiliently seated on the pegs (11) whereby the plate (4) together with the pegs (11) forms a closed punch surface.

2. The garlic cutter according to claim 1, wherein said beaker shaped inner structure (2) is secured to said housing (1) and thereby prevented from falling through a bottom portion thereof.

3. A garlic cutter comprising:

a housing (1) bearing a cutting blade (7);

an upper part (3) bearing an affixed punch(9) which in an operational state during rotation relative to the housing (1) moves axially toward a co-rotating cutting grid (6); and a breaker-shaped inner structure (2) adapted to receive garlic and rotatably supported in the housing (1) and containing the cutting grid (6).

4. The Garlic cutter as claimed in claim 3, wherein the inner structure (2) is held by a decent mechanism in the housing (1) and is easily removable for cleaning.

5. The Garlic cutter as claimed in claim 4, wherein the cutting grid (6) is detachable from the inner structure (2) for purposes of cleaning.

6. The Garlic cutter as claimed in claim 5, wherein, the cutting blade (7) is detachable from the housing for purposes of cleaning.

7. The Garlic cutter as claimed in claim 6 wherein, a cross-section of the inner structure (2) is substantially square and corresponds to that of the punch (9).

* * * * *